US005988494A

United States Patent [19]

Fontaine

[11] Patent Number: 5,988,494

[45] Date of Patent: Nov. 23, 1999

[54] CARTON BLANK AND METHOD FOR FORMING THE CARTON BLANK

[75] Inventor: Alan Fontaine, Louisville, Colo.

[73] Assignee: Graphic Packaging Corporation, Paoli, Pa.

[21] Appl. No.: 09/164,876

[22] Filed: Oct. 1, 1998

[51] Int. Cl.[6] ..... B65D 5/42

[52] U.S. Cl. ..... 229/249; 53/477; 53/376.6; 493/133; 493/162; 229/125.42

[58] Field of Search ..... 229/123.1, 125.42, 229/137, 138, 249; 493/133, 162; 53/376.6, 477, 491

[56] References Cited

U.S. PATENT DOCUMENTS

| | | | |
|---|---|---|---|
| 4,055,672 | 10/1977 | Hirsch et al. | 229/123.1 |
| 4,254,173 | 3/1981 | Peer, Jr. | 428/204 |
| 4,313,553 | 2/1982 | Lisiecki | 229/249 |
| 4,762,234 | 8/1988 | Wyberg | 229/138 |
| 4,915,289 | 4/1990 | Hatano et al. | 229/123.1 |
| 5,228,616 | 7/1993 | Kjelgaard | 229/123.1 |
| 5,255,494 | 10/1993 | Doyle | 229/249 |
| 5,501,394 | 3/1996 | Eno | 53/376.6 |
| 5,728,249 | 3/1998 | Kinsey, Jr. et al. | 53/477 |
| 5,816,487 | 10/1998 | Skinner | 229/125.42 |

*Primary Examiner*—Gary E. Elkins
*Attorney, Agent, or Firm*—Klaas, Law, O'Meara & Malkin, P.C.; William P. O'Meara, Esq.; Joseph J. Kelly, Esq.

[57] ABSTRACT

A gable top for a carton formed from a carton blank having an outer layer bonded to an intermediate layer by a first strength and an inner layer bonded to the intermediate layer by a second strength less than by a first strength and wherein the intermediate layer is of an esthetically pleasing color and formed into a gable top by sealing together facing portions of the inner layer so that when the gable top is separated to form a pour spout the inner surface of the pour spout will be aesthetically pleasing.

19 Claims, 3 Drawing Sheets

CARTON BLANK AND METHOD FOR FORMING THE CARTON BLANK

FIELD OF THE INVENTION

This invention relates generally to a pour spout for a container and more particularly to a pour spout for a container that is aesthetically pleasing after it has been opened.

BACKGROUND OF THE INVENTION

There are many types of containers on the market that have reclosable pour spouts so that the pour spout of the container may be opened, a portion of the material in the container removed and the pour spout is then closed. This operation may be repeated until the container is empty. To protect the material in the container, prior to the initial opening, it is necessary to have all portions of the container sealed. This is the same whether the material is a liquid, such as milk, or a solid, such as a snack of relatively small particles. One form of pour spout for such a container is known as a gable top. In such a container, it is essential that the pour spout be aesthetically pleasing after it has been opened. In prior art containers, a plastic material, such as a polyethylene was applied to the inner surface of a paperboard material used to form carton blanks so that the carton formed from such a carton blank could be heat sealed in its manufacture. During the manufacture and prior to the heat sealing, a suitable release coating was applied to the portions of the surfaces that were to be heat sealed. Due to manufacturing tolerances, the thicknesses of the release coatings were not constant so that it often occurred that portions of polyethylene would be torn away from the paperboard on the opening of the gable top to form the pour spout leaving the portions of the paperboard exposed. In other instances, the release coating would be spaced from the heat sealing portions so that when the gable top was opened, portions of the polyethylene would be torn away from the paperboard leaving portions of the paperboard exposed. Therefore, in order to preserve the aesthetic appearance of the opened pour spout, it was necessary to form the paperboard with a pigmentation of a pleasing color such as white. The manufacture of a pigmented paper board is expensive so that it has been desirable to produce a less expensive carton but one that would be aesthetically pleasing when opened.

BRIEF DESCRIPTION OF THE INVENTION

This invention provides a carton blank and a method for forming the carton blank so that a carton formed from such a carton blank may be heat sealed and such a carton has a pour spout that may be opened and be aesthetically pleasing.

In a preferred embodiment of the invention, a carton blank has an outer layer of a conventional paperboard formed from a kraft fiber or a recycled kraft fiber that has a brownish or relatively dark color. An intermediate layer of a first, plastic material, such as polypropylene, is superposed over and bonded to the paperboard material and an inner layer of a second plastic material, such as polyethylene, is superposed over and bonded to the intermediate layer of the first plastic material. The first and second layers of the plastic materials are preferably extruded. The bond between the intermediate layer of a first plastic material and the paperboard material has a greater strength than the bond between the intermediate layer of a first plastic material and the inner layer of a second plastic material. In the preferred embodiment, the intermediate layer of the first plastic material is of an aesthetically pleasing color, such as white, and the inner layer of the second plastic material is preferably transparent. Therefore, when a carton having a pour spout formed from such a carton blank and heat sealed to bond together adjacent portions of the inner layer of a second plastic material is opened, at least portions of the inner layer of a second plastic material will separate from adjacent portions of the intermediate layer of a first plastic material so as not to expose any portion of the paperboard. In some instances, continuous portions of the heat sealed together second plastic material will stay together so that these continuous portions will be separated from one portion of the intermediate layer of a first plastic material. The shear strength of the second plastic material is less than the strength of the bond between the intermediate and inner layers and less than the strength of the bond between the heat sealed together portions of the inner layer.

As a precautionary measure, it may be desirable to apply a release coating to the portions of the continuous layer of a second plastic material that are to be heat sealed together. However, if the release coating fails for any reason, the portions of the second plastic material will separate from the adjacent portions of the first plastic material so that no portions of the paperboard material will be exposed.

BRIEF DESCRIPTION OF THE DRAWINGS

An illustrative and presently preferred embodiment of the invention is illustrated in the accompanying drawings in which.

DETAILED DESCRIPTION OF THE INVENTION

Figure 1:
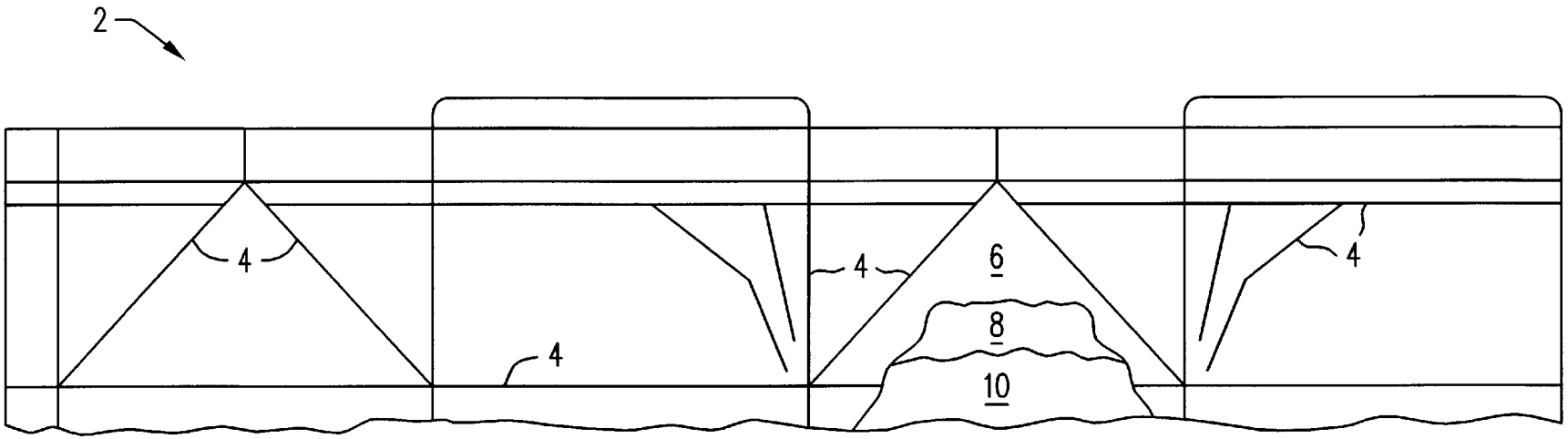
FIG. 1 is a top plan view of the top portion of a carton blank of the instant invention.
Figure 2:
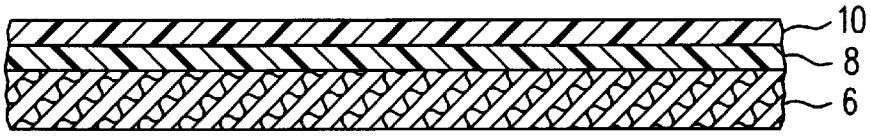
FIG. 2 is a cross-sectional view of the layers of material forming the carton blank.

A carton blank 2 is illustrated in FIGS. 1 and 2 provided with a plurality of fold lines 4. The carton blank 2 comprises an outer layer 6, an intermediate layer 8 and an inner layer 10. The outer layer 6 is formed from a conventional paperboard material or a composite material such as that described in U.S. Pat. No. 4,254,173 to Peer, Jr., having a dark colored inner surface. The intermediate layer 8 is formed from a first plastic material that adjacent superposed portions thereof are not readily sealable together by the application of heat. The first plastic material preferably is polypropylene, such as that marketed by MOMTEL under the trade designation PF 611, or other types of plastic material having similar non-heat sealing characteristics. The inner layer 10 is formed from a second plastic material that adjacent superposed portions thereof may be readily sealable together by the application of heat. The second plastic material preferably is polyethylene, or other types of plastic material having similar heat sealing characteristics.

The intermediate layer 8 of a first plastic material is secured to the outer layer 6 by a first bond having a relatively strong predetermined first strength. The inner layer 10 is secured to the intermediate layer 8 by a second bond of a second strength that is less than the first strength. The heat sealed together portions of the inner layer 10 are secured together by a third bond of a third strength that is greater than the second bond between the layers 8 and 10 but less than the first bond between the layers 6 and 8 for purposes described below. The shear strength of the second plastic material forming the inner layer 10 adjacent to the heat sealed together portions is less than the third bond strength of the heat sealed together portions and the second bond strength between the continuous layers of a first and a second plastic material for purposes described below.

Figure 3:
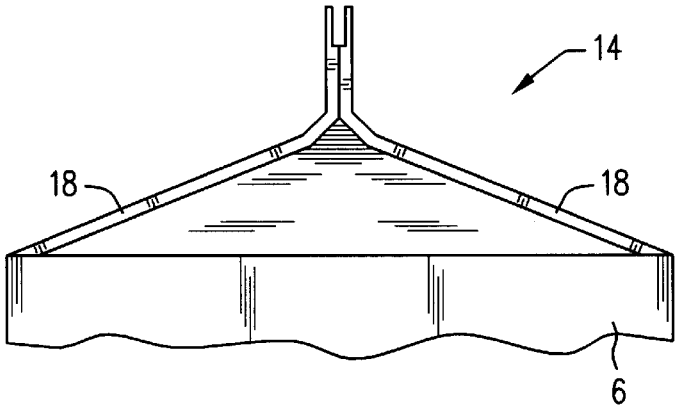
FIG. 3 is a side elevational view of the top portion of a carton formed into a conventional gable top from the carton blank of FIG. 1.

In FIG. 3, there is illustrated the carton blank of FIG. 1 having been folded around the fold lines 4 and adjacent portions thereof secured together to form a conventional gable top 14.

Figure 4:
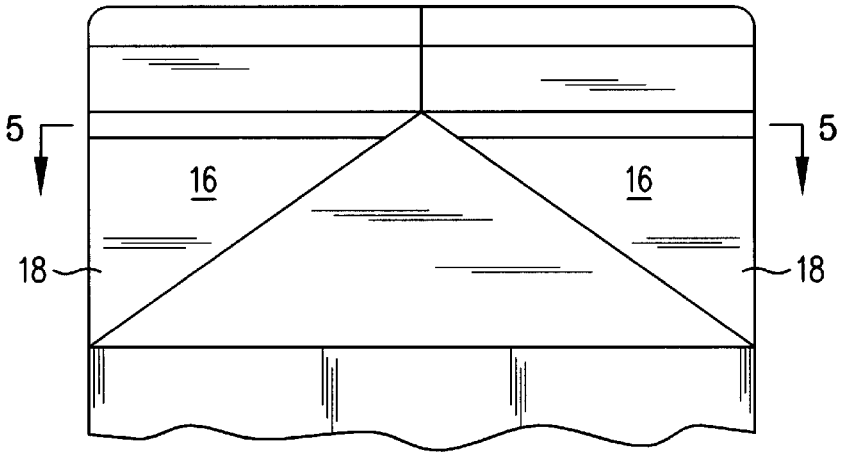
FIG. 4 is a side elevational view of the top portion of a carton formed from a carton blank of FIG. 1 after a first opening operation.

In FIG. 4, the first opening operation has been performed on the conventional gable top 14 of FIG. 3. The first opening operation is performed in the conventional manner. A force is applied to the inner surfaces 16 of the portions 18 to move the portions 18 upwardly and outwardly.

Figure 5:
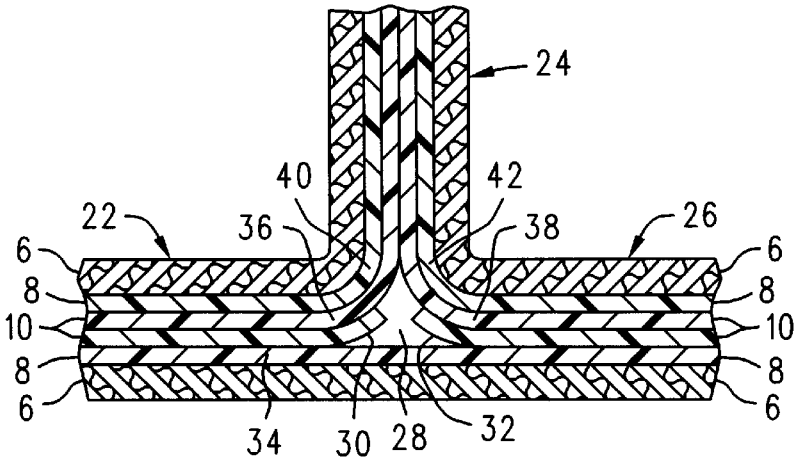
FIG. 5 is a cross-sectional view taken on the line 5—5 of FIG. 4.

In FIG. 5, there is illustrated the location of portions of the layers 6, 8 and 10 after the first opening operation. Layers 6, 8 and 10 remain in a sealed together relationship at locations 22, 24 and 26 but a separation has occurred at location 28. Portions 30 and 32 of one of the inner layers 10 have separated from a portion 34 of one of the intermediate layers 8 but remain secured to adjacent portions of the other of the inner layers 10. In some instances, the reverse orientation of the illustration in FIG. 5 may occur. The portions 30 and 32 will remain secured to the portion 34 while the portions 36 and 38 of the other inner layer 10 remain secured to the portions 30 and 32 but separate from the portions 40 and 42 of the other intermediate layer 8.

Figure 6:
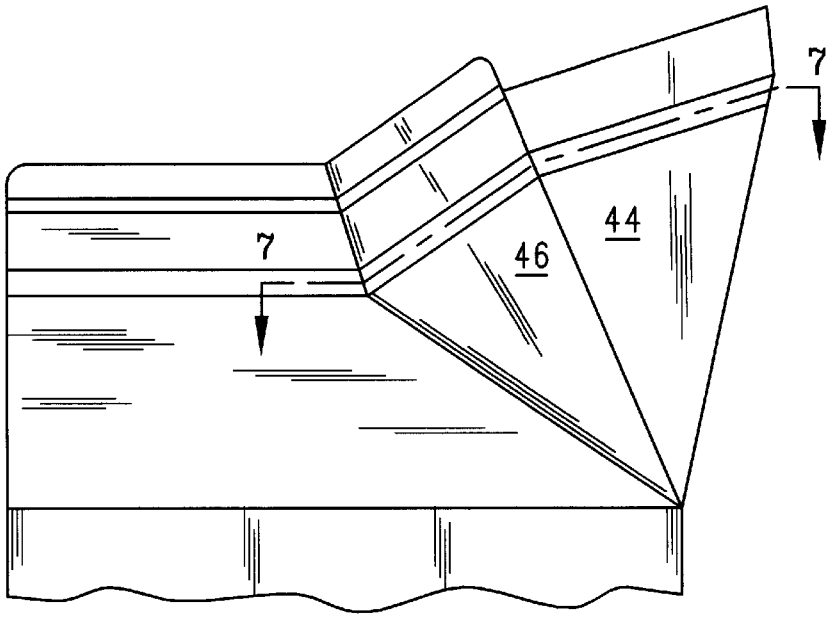
FIG. 6 is a front elevational view of a carton formed from the carton blank of FIG. 1 after a second opening operation.

In FIG. 6, there is illustrated the gable top carton of FIG. 4 after a second opening operation has been performed. The second opening operation is performed in the conventional manner. A finger tip is placed into the separation 28 and an outwardly directed force is applied to an adjacent portion of the intermediate layer 8. This moves the portions 44 and 46 outwardly and at the same time separates the portions 44 from the portions 46.

Figure 7:
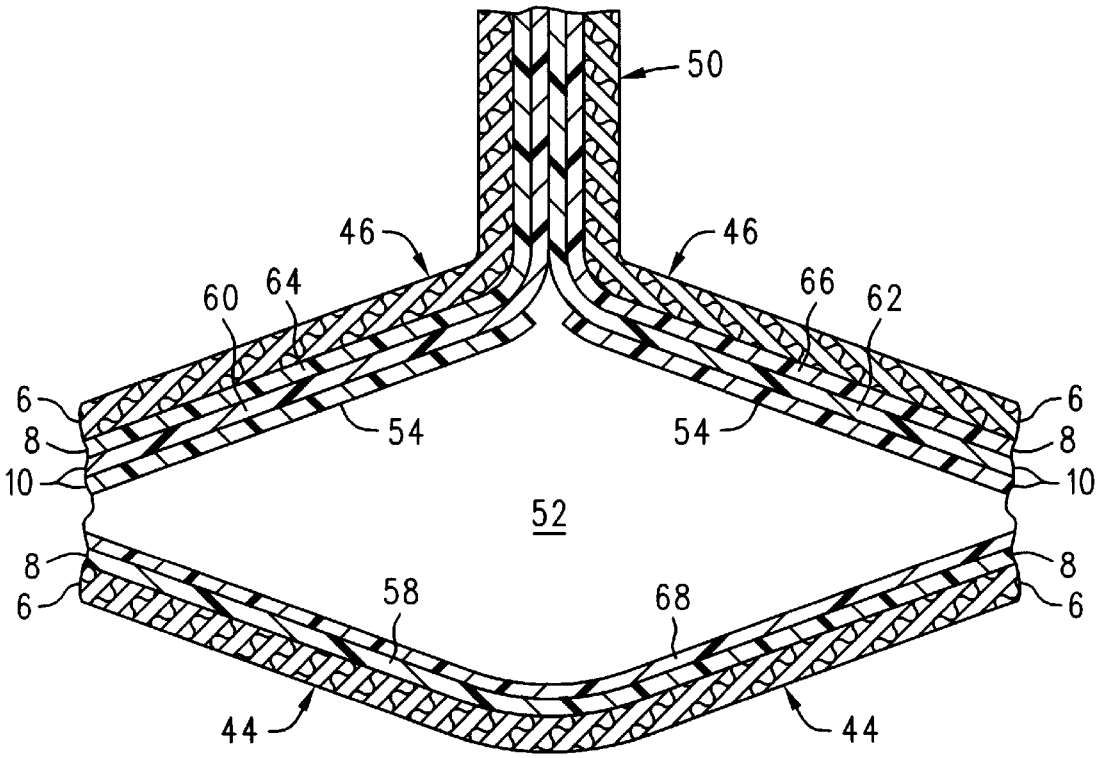
FIG. 7 is a cross-sectional view taken on the line 7—7 of FIG. 6.

In FIG. 7, there is illustrated the location of portions of the layers 6, 8 and 10 after the second opening has been made. The layers 6, 8 and 10 at location 50 remain secured together but a separation occurs at location 52. Portions 54 and 56 of one of the inner layers 10 have separated from the portion 58 of one of the intermediate layers 8 but remain secured to adjacent portions of the other of the inner layers 10. As stated above, in some instances, the reverse orientation of the illustration in FIG. 7 may occur. The portions 54 and 56 will remain secured to the portion 58 while the portions 60 and 62 of the other inner layer 10 remain secured to the portions 54 and 56 but separate from the portions 64 and 66 of the other of the intermediate layers 8.

As illustrated at the locations 22, 24 and 26 of FIG. 5 and location 50 of FIG. 7, the adjacent portions of the inner layers 10 are heat sealed together. When the force is applied in the second opening operation, the portions 54 and 56 separate from the portion 58 and move with the portions 60 and 62 since the bond between the heat sealed together portions of the inner layers 10 is greater than the bond between the adjacent portions of the layers 8 and 10. However, if the bond between the heat sealed portions of the inner layers 10 is greater than the shear strength of the second plastic material forming the inner layer 10, the portion 68 of the one of the inner layers 10 will remain secured to the portion 58 of the one of the intermediate layers 8.

In a preferred embodiment of the invention, the first plastic material forming the intermediate layer 8 is of an aesthetic color, such as white. The second plastic material forming the inner layer 10 preferably is transparent. Therefore, when the gable top 14 is opened, the exposed inner portions of the opened gable top still retain a desired aesthetic appearance.

As a precautionary measure, it may be desirable to coat at least selective sections of those of the gable top that are to be heat sealed together with a releasable coating so that the heat sealed portions may be readily separated. The at least selective sections include the portions of the carton that are to be opened to form the spout. If the release coating fails for any reason, the heat sealed portions of the inner layers 10 will remain secured together and separate from one of the adjacent portions of the intermediate layer 8 as described above. Therefore, the opened gable top will retain the desired aesthetic appearance.

It is contemplated that the inventive concepts herein described may be variously otherwise embodied and it is intended that the appended claims be construed to include alternative embodiments of the invention except insofar as limited by the prior art.

What is claimed:

1. A carton blank for forming a closed carton by folding and sealing together portions of the carton blank comprising:

an outer layer of a relatively rigid material having an outer surface and an inner surface;

an intermediate layer of a first plastic material secured to said inner surface of said outer layer by a first bond of a predetermined first strength;

said intermediate layer having an inner surface;

an inner layer of a second plastic material secured to said inner surface of said intermediate layer by a second bond of a second strength that is less than said first strength so that when a sufficient force is applied to at least a portion of said inner layer, said at least a portion of said inner layer will separate from the corresponding at least a portion of said intermediate layer but said corresponding at least a portion of said intermediate layer will not separate from said outer layer.

2. A carton blank as in claim 1 wherein:

at least said first plastic material is fluid impervious; and said second plastic material being heat sealable so that superposed portions thereof may be sealed together by the application of heat without adding to the strength of said second bond.

3. A carton blank as in claim 2 wherein:

said first plastic material comprises polypropylene; and said second plastic material comprises polyethylene.

4. A carton blank as in claim 3 wherein:

said polypropylene is a desired aesthetic color; and said polyethylene is transparent.

5. A carton blank as in claim 1 wherein:

said second plastic material having shear strength less than the strength of said second bond.

6. A carton blank as in claim 1 and further comprising:

a release coating on at least selective sections of said portions of said continuous layer of a second plastic material that are to be heat sealed together so that an effective but more easily opened seal is obtained at said selective sections.

7. A carton blank as in claim 6 wherein:

at least said first plastic material is fluid impervious; and said second plastic material being heat sealable so that superposed portions thereof may be sealed together by the application of heat without adding to the strength of said second bond.

8. A carton blank as in claim 7 wherein:

said first plastic material comprises polypropylene; and said second plastic material comprises polyethylene.

9. A carton blank as in claim 8 wherein:

said polypropylene is a desired aesthetic color; and said polyethylene is transparent.

10. A carton blank as in claim 6 wherein:

said second plastic material having shear strength less than the strength of said second bond.

11. A method for forming a closed carton having a partially openable gable top which may be opened to form a spout while retaining an anesthetic appearance to the inner surface of the opened spout comprising:

forming a carton blank having an outer layer of a relatively rigid material, an intermediate layer of a first plastic material and an inner layer of a second plastic material;

bonding together said outer layer and said intermediate layer with a first bond of a predetermined first strength;

bonding together said intermediate layer and said inner layer with a second bond of a second strength which second strength is less than said first strength;

forming fold lines in said carton blank;

folding said carton blank to form a carton having a gable top so that portions of said inner layer forming said gable top are in a face to face relationship;

applying heat to said portions of said inner layer to bond said portions of said inner layer together with a third bond of a third strength that is greater than said second strength but less than said first strength.

12. A method as in claim 11 and further comprising:

said second plastic material having shear strength that is less than said second strength of said second bond and less than the strength of the heat sealed together portions of said second plastic material.

13. A method as in claim 12 and further comprising:

using a polypropylene material as said first plastic material; and using a polyethylene material as said second plastic material.

14. A method as in claim 11 wherein said outer layer has an outer surface and an inner surface and further comprising:

applying said first plastic material as a continuous layer over the entire portion of said inner surface so that said first plastic material has an exposed inner surface; and applying said second plastic material as a continuous layer over the entire portion of said exposed inner surface of said first plastic material.

15. A method as in claim 14 and further comprising:

said second plastic material having shear strength that is less than said second strength of said second bond and less than the strength of the heat sealed together portions of said second plastic material.

16. A carton having a gable top so that sealed together portions of the gable top may be separated to form a pour spout without impairing the aesthetic appearance of the exposed inner surface of the pour spout comprising:

a carton having a gable top formed from a plurality of superposed layers of materials having at least portions thereof sealed together to form an effective seal;

said at least sealed together portions comprising:

an outer layer of a relatively rigid material having at least a first section and a second section integral with said first section and joined thereto by a fold line and said outer layer having an inner surface;

an intermediate layer of a first plastic material secured to said inner surface of said outer layer and having a first section and a second section integral with said first section and joined thereto by a fold line and said intermediate layer having an inner surface;

said intermediate layer being secured to said outer layer by a first bond of a predetermined first strength;

an inner layer of a second plastic material secured to said inner surface of said intermediate layer and having a first section and a second section integral with said first section and joined thereto by a fold line and said inner layer having an inner surface;

said inner layer being secured to said intermediate layer by a second bond having a second strength less than said first strength;

said fold lines of said outer, intermediate and inner layers being in a superposed relationship;

said outer, intermediate and inner layers being folded around said fold lines so that at least portions of said inner surface of said inner layer are in a face to face relationship; and said at least portions of said inner surface of said inner layer being secured together by a third bond having a third strength that is less than said first strength but more than said second strength.

17. A carton as in claim 16 and further comprising:

said second plastic material having a shear strength less than said second strength of said second bond and less than said third strength of said third bond.

18. A carton as in claim 17 and further comprising:

a release coating on at least one of said at least portions of said inner surface of said inner layer to facilitate separation of said third bond therebetween.

19. A carton as in claim 16 and further comprising:

a release coating on at least one of said at least portions of said inner surface of said inner layer to facilitate separation of said third bond therebetween.

* * * * *